US007181946B2

(12) United States Patent
Krüger et al.

(10) Patent No.: US 7,181,946 B2
(45) Date of Patent: Feb. 27, 2007

(54) DEVICE FOR WINDING AND UNWINDING HOT-ROLLED PRE-STRIPS CONSISTING OF HOT METAL

(75) Inventors: Matthias Krüger, Hilchenbach (DE); Jürgen Merz, Kreuztal (DE); Karl-Friedrich Fuhrmann, Hilchenbach (DE)

(73) Assignee: SMS Demag AG, Düsseldorf (DE)

( * ) Notice: Subject to any disclaimer, the term of this patent is extended or adjusted under 35 U.S.C. 154(b) by 104 days.

(21) Appl. No.: 10/486,407

(22) PCT Filed: Aug. 5, 2002

(86) PCT No.: PCT/EP02/08713

§ 371 (c)(1),
(2), (4) Date: Feb. 6, 2004

(87) PCT Pub. No.: WO03/013753

PCT Pub. Date: Feb. 20, 2003

(65) Prior Publication Data

US 2004/0239018 A1 Dec. 2, 2004

(30) Foreign Application Priority Data

Aug. 8, 2001 (DE) ..... 101 38 857

(51) Int. Cl.
*B21C 47/00* (2006.01)
*B65H 19/22* (2006.01)
*B65H 19/00* (2006.01)

(52) U.S. Cl. ..... 72/146; 242/533.2; 242/558

(58) Field of Classification Search ..... 72/250, 72/205, 206, 146, 148, 183; 242/520, 532, 242/535.1, 533.2, 533.3, 533.7, 558, 559, 242/556

See application file for complete search history.

(56) References Cited

U.S. PATENT DOCUMENTS

| | | | | |
|---|---|---|---|---|
| 2,756,943 | A * | 7/1956 | Sieger | 242/559.3 |
| 3,226,050 | A * | 12/1965 | Engel | 242/559.3 |
| 3,695,542 | A | 10/1972 | Briggs | |
| 4,019,359 | A * | 4/1977 | Smith | 72/146 |
| 5,310,131 | A | 5/1994 | Monaco et al. | |

(Continued)

FOREIGN PATENT DOCUMENTS

DE 2519988 11/1975

(Continued)

OTHER PUBLICATIONS

Korabi T et al: "New Developments Expand Coilbox Applications", Iron and Steel Engineer, vol. 73, No. 12, Dec. 1, 1996, pp. 13-19.

*Primary Examiner*—Lowell A. Larson
*Assistant Examiner*—Teresa M. Bonk
(74) *Attorney, Agent, or Firm*—Friedrich Kueffner

(57) ABSTRACT

The aim of the invention is to configure a device for winding and unwinding partly rolled products, in a way that ensures the smallest possible accumulation of scrap. To achieve this, a roller (20, 20', 20") whose position is controlled and which runs on the periphery of the coil is used during the transfer of the coils from the winding station to the unwinding station. The vertical adjustment of said roller ensures that the coil is completely unwound, even with a diminishing coil diameter.

7 Claims, 3 Drawing Sheets

U.S. PATENT DOCUMENTS 5,956,990 A 9/1999 Ginzburg
5,987,955 A * 11/1999 Benner ..... 72/250

FOREIGN PATENT DOCUMENTS

DE 3011487 10/1980
DE 3011515 10/1980
EP 0933147 8/1999

* cited by examiner

DEVICE FOR WINDING AND UNWINDING HOT-ROLLED PRE-STRIPS CONSISTING OF HOT METAL

The invention concerns equipment for the optional coiling of partly rolled product, uncoiling and transfer of the formed coils, or for allowing the partly rolled product to pass through uncoiled, with a set of bending rolls, which produces a downward bend in the rolled product passing through it, with a roller table, whose drive rolls support the coiling operation and effect uncoiling operations and further conveyance of formed coils to free the coiling position, and with a drive unit that conveys partly rolled product that is passing through or that has been uncoiled.

DE-OS 25 19 988 discloses equipment for coiling and uncoiling hot-rolled hot-metal pre-strips, by means of which hot-rolled pre-strip can be coiled without a mandrel in position and with which the coiled coil can be raised from the coiling position into an uncoiling position by means of an arm that engages the eye of the coil. Even before the transfer and during the transfer operation, the pre-strip is uncoiled from the coil, so that at least the regions of the pre-strip that are in the eye of the coil uncoil on the arm and can be damaged there, with the result that a large amount of scrap is produced.

It has also already been proposed that the coiled coils be moved or rolled over the roller table into the uncoiling position from the coiling position by means of rolls that can be placed on the outer periphery of the coil and swiveled by means of levers.

However, this transfer movement is uncontrolled, so that the coil rolls against stops arranged in the uncoiling position, which can lead to damage of the outer turn of the coil, before the coil drops into its predetermined uncoiling position.

During the uncoiling, the diminishing coil can be pulled out of the uncoiling position by the force of the drive unit that is drawing it off. The remainder of the coil is then pulled under the stop into the drive unit, where several turns of the coil may then pass through the drive unit together, or jamming and shutdown of the system may occur. Here again, large amounts of scrap may be produced.

Coil transfer equipment has also already been proposed, in which the coils are transferred from the coiling position to the uncoiling position by corresponding tipping or lifting of the roller table rolls. The problems associated with drawing off the coil, especially as it becomes smaller, could not be solved here, either.

EP 0,933,147 A, which describes equipment of this general type, discloses a retaining roll, but its only purpose is to hold down the last turn to ensure the orderly entry of the pre-strip into the finishing train. During the transport of the coil from the coiling station to the uncoiling station and during the start of the uncoiling operation, the pre-strip may still suffer damage, and thus scrap may still be produced.

The objective of the invention is to refine equipment of this general type in such a way that cost-effective operation of the equipment is ensured and that as little scrap as possible is produced during the operation.

This objective is achieved by providing at least one roll, which runs on the periphery of the coil that is to be transferred or has been transferred into the uncoiling position and holds the coil in the uncoiling position. In this operation, the roll ensures that the coil is safely transferred to the uncoiling position without rolling beyond it against stops, and that the coil remains securely in the uncoiling position during its entire uncoiling phase, so that the end portion of the coil cannot reach the drive unit that follows.

If the rolls of the roller table and the rolls that support the periphery of the coil are simultaneously designed to be power-driven to move in the running direction of the partly rolled product, then the roll running on the periphery of the coil can protect the coil from unwanted movements in the running direction of the partly rolled product even during the transfer movement from the coiling position to the uncoiling position.

If the support rolls are arranged in a common carriage, and the carriage can be moved in the running direction of the partly rolled product, this ensures that the coil does not have to be moved or rolled over several rolls of a roller table, so that significantly less damage of the outer turns of the coil will occur.

It was found to be advantageous, if the support rolls can also be moved vertically by at least one drive and can be lowered as the coil diameter decreases, and in this case the drive is equipped with a control device, which vertically lowers the support rolls as a function of the coil diameter and/or the uncoiled length and/or the uncoiling time. This allows optimum adaptation of the support position of the support rolls to the coil diameters, so that even coil diameters that have become extremely small can still be reliably supported.

To prevent even more reliably the partly rolled product that is being uncoiled from being drawn into the drive unit, it was found to be effective, to lower a lever onto the partly rolled product that is running off the coil. The lever has an idler roll, which rests on the partly rolled product, and a support roll, which is positioned at a higher level and rests against the periphery of the coil.

Another possibility for ensuring that the partly rolled product is completely uncoiled from the coil before it reaches the drive unit is achieved by providing mandrels, which can be inserted in the eye of a coil, on each side of the roller table in the end position of the eye of the coil that is to be uncoiled. The mandrels can be inserted in the eye of the remainder of the coil as a function of the coil diameter and/or the uncoiled length and/or the uncoiling time. Rolls are arranged on the mandrels and, when necessary, can be driven at uncoiling speed to preclude damage to the partly rolled product.

The invention is explained in greater detail below with reference to a specific embodiment.

Figure 1:
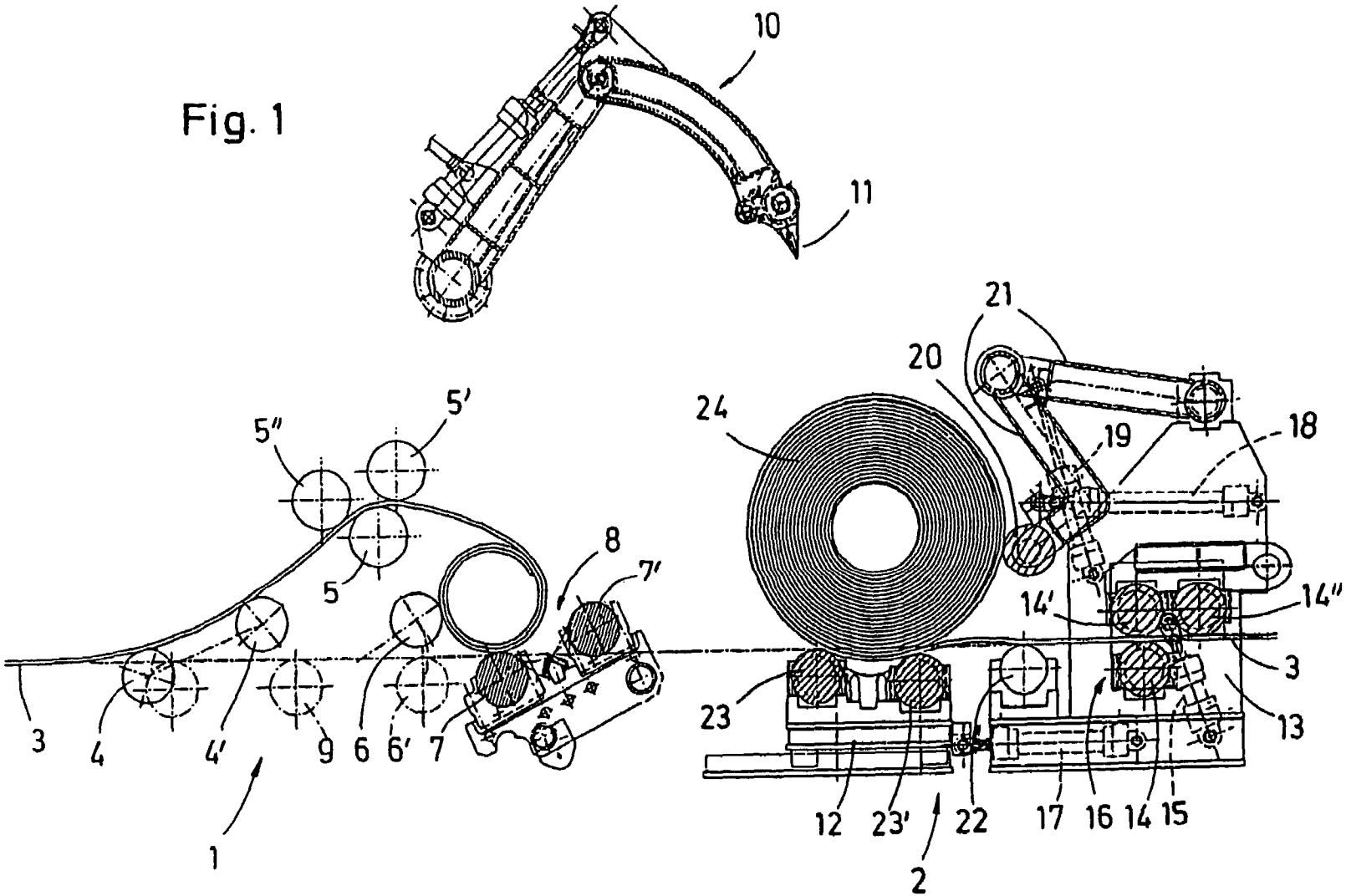
FIG. 1 shows a schematic drawing of an embodiment of the equipment of the invention for coiling/uncoiling partly rolled product.

FIG. 1 shows a coiling station 1 and an uncoiling station 2 for partly rolled strip product 3. The coiling station 1 is a mandrel-less downward coiler of a type that is already well known, in which the strip 3 entering the coiling station 1 is deflected upward over entry rolls 4, 4'. Downward curvature is imparted to the strip 3 by the bending rolls 5, 5', 5". The strip 3 is wound into a coil in the coiling chamber 8 formed by the rolls 6, 6' and 7, 7'.

Both the entry rolls 4 and roll 7' can be lowered from the raised positions shown in the drawing to the level of roll 6' and the roller table roll 9. In this position, the rolls 4, 9, 6', 7 and 7' form a roller table, by which the strip 3 can be guided through the coiling station 1 without being deflected.

The coiling station is equipped with a strip coil opener 10, which, after the coil has been wound in the coiling chamber 8, and the direction of rotation of the driven rolls 7, 7' has been reversed, can be swiveled against the coil to open it with the peeling tool 11 and guide the leading end of the strip to the uncoiling station 2.

The uncoiling station 2 comprises a carriage 12 and a column 13, which supports the drive rolls 14, 14', 14" of the drive unit 16. The drive rolls 14, 14', 14" can be adjusted by a piston-cylinder unit 15. A displacement cylinder 17 for the carriage 12 is provided on the column 13. In addition, a roll 20 is pivoted on the column 13 on an elbow lever 21 and can be adjusted in its horizontal direction by a piston-cylinder unit 18 and in its vertical direction by a piston-cylinder unit 19. The column 13 also has a roller table roll 22, by which the strip 3 can be fed to the drive unit 16.

Driven rolls 23, 23' are arranged on the carriage 12 and can drive the coil 24 to perform an uncoiling movement.

The equipment in FIG. 1 can be operated to allow the strip to pass straight through. For this purpose, the rolls 4, 7, 7' and 23, 23' must be lowered to the level of the roller table, so that these rolls and rolls 6' and 22 form a roller table, over which the strip 3 can run directly to the drive unit 16 from the inlet of the coiling station 1.

However, the strip 3 is usually guided by the entry rolls 4, 4' and the bending rolls 5, 5', 5" into the coiling chamber 8, in which it is wound into a coil. At the start of the coiling operation, the roll 7' is still positioned in the raised position shown in the drawing. As soon as several turns of the coil have been wound, the roll 7' is lowered to the level of the roller table, and the coil is then supported only by the driven rolls 7, 7'. This position is then maintained until the coil is completely wound.

The finished coil, which had been driven clockwise during the coiling operation, is now driven counterclockwise by reversing the direction of rotation of the driven rolls 7, 7'. At the same time, the strip coil opener 10 is swiveled against the coil, so that the former trailing end of the strip is now peeled off the coil as the leading end of the strip and fed to the drive unit 16. In the meantime, the displacement cylinder 17 has been extended, so that the carriage 12, which no longer holds a coil 24, is moved up to the roll 7'. At the same time, the roll 20 is swiveled by the piston-cylinder units 18, 19 towards the coiling station 1 and into a position against or almost against the coil that is located there.

As soon as the drive unit 16 has gripped the strip 3, the roll 7 is raised to transfer the coil out of the coiling station 1 onto the rolls 23, 23' of the carriage 12 and into the uncoiling station 2. In this connection, the roll 20, which, if necessary, can be swiveled back towards the column 13 during the transfer operation, ensures that the coil 24 cannot roll beyond the roll 23'.

The carriage 12 and the roll 20 are then moved towards the column 13, so that the coiling station 1 is freed for the coiling of a new coil. As the coil 24 in the uncoiling station 2 becomes smaller, the roll 20 can be vertically adjusted by the piston-cylinder unit 19 in such a way that even a very small end portion of the coil can be reliably supported by the roll 20, so that the end portion of the coil cannot be drawn into the drive unit 16.

Figure 2:
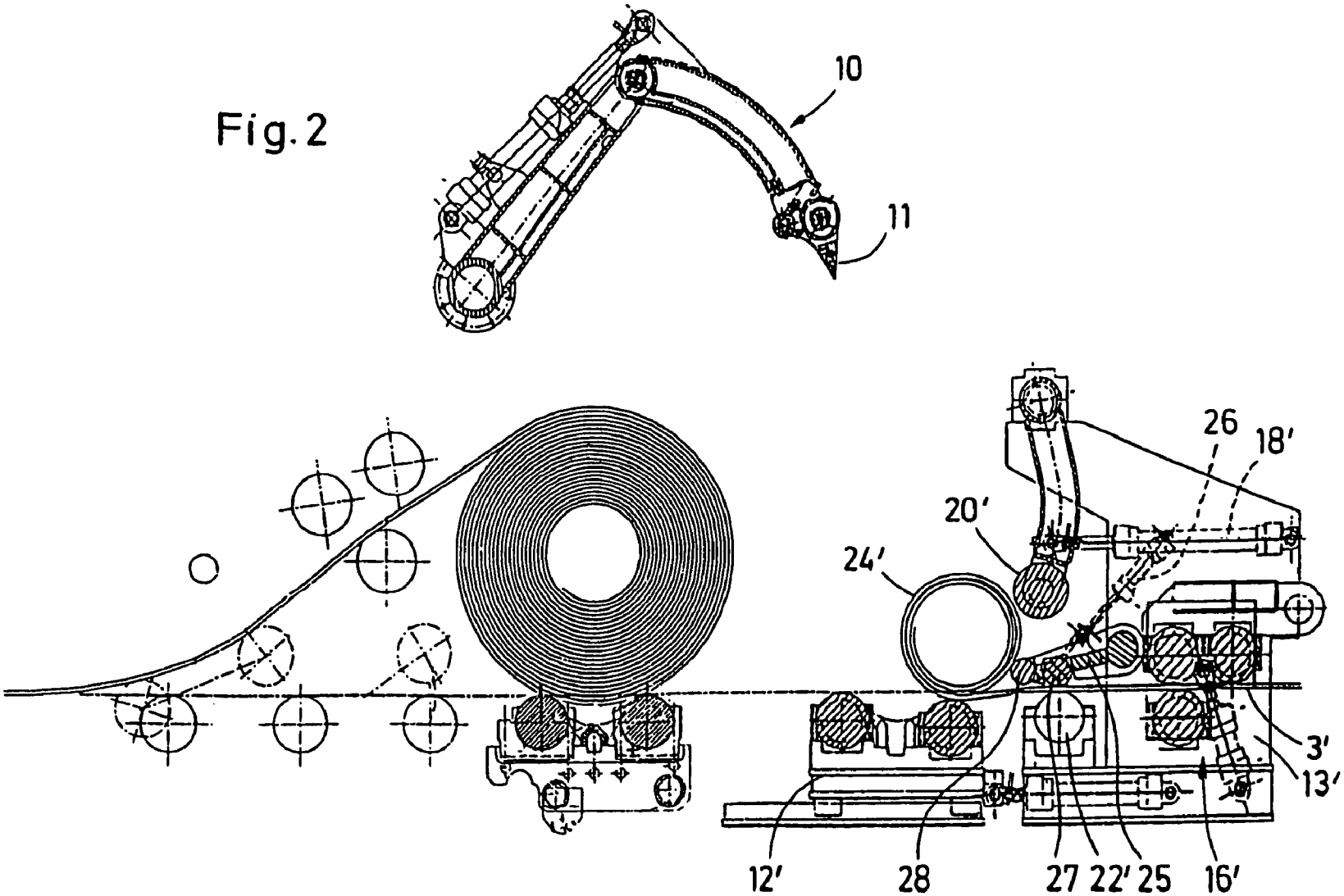
FIG. 2 shows a schematic drawing of an embodiment of the equipment of the invention with a lever that can be lowered onto the partly rolled product.

FIG. 2 shows a roll 20', which is similar to roll 20, but which can be adjusted basically only horizontally by a piston-cylinder unit 18'. To prevent the end portion of the coil 24' from being drawn into the drive unit 16', a lever 25 is provided, which can be swiveled towards the strip 3' by a piston-cylinder unit 26. The lever 25 has rolls 27, 28, of which the idler roll 27 can be swiveled against the roller table roll 22', and the roller table roll 22' and the idler roll 27 enclose the strip 3' between them. The support roll 28 is arranged at the tip of the lever 25 in such a way that it rests against the end portion of the coil 24' without touching the strip 3' in the drive unit entry region.

Figure 3:
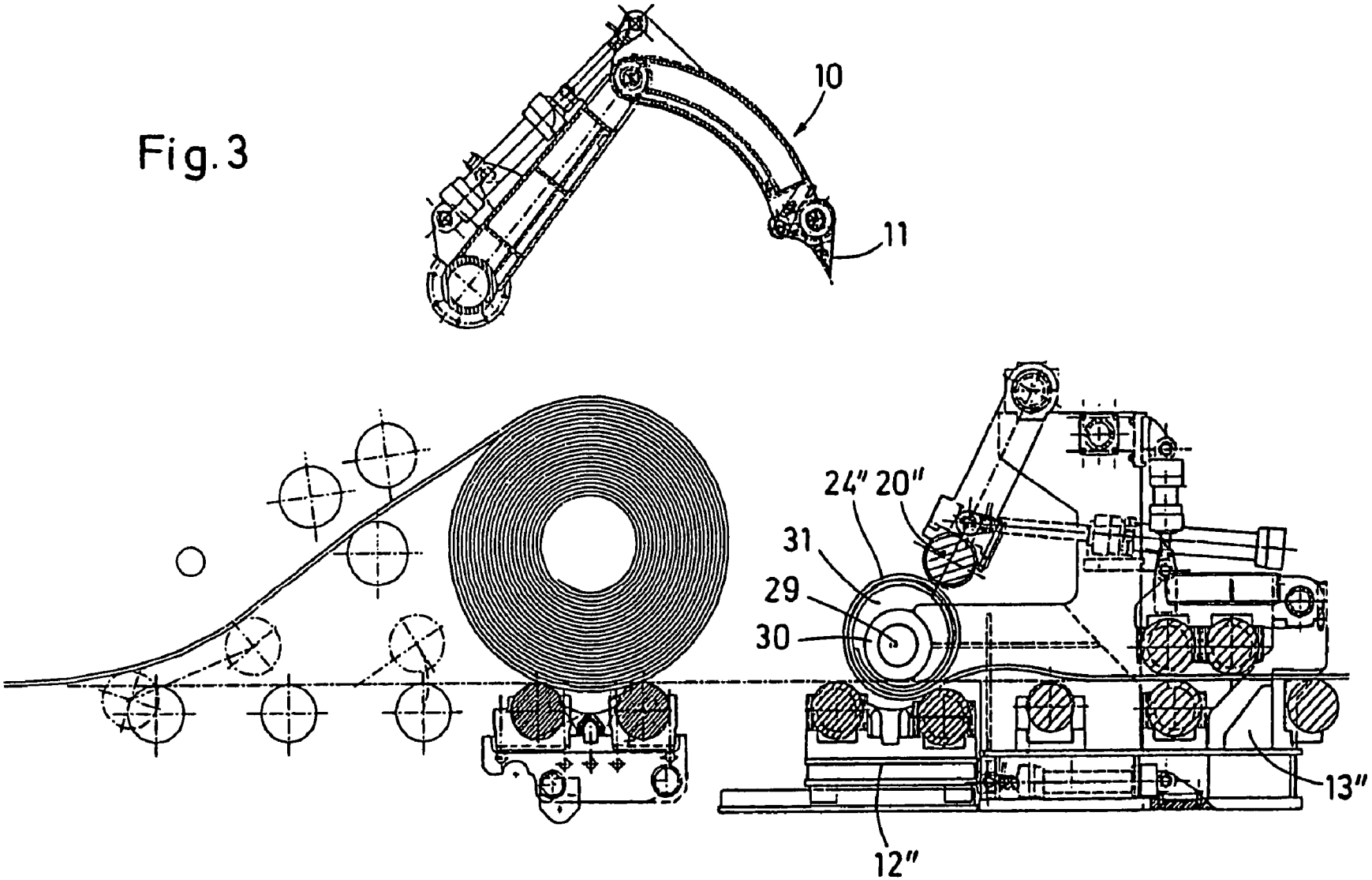
FIG. 3 shows a schematic drawing of an embodiment of the equipment of the invention with mandrels that can be inserted into the coil.

FIG. 3 shows another alternative, which ensures that the coil 24" is completely unwound. Here again, the roll 20", which can be swiveled basically in the horizontal direction, ensures that the coil remains securely on the carriage 12". A mandrel 29 is provided on the column 13" on each side of the roller table and the carriage 12", and a roll 30 is provided on each mandrel. As the uncoiling operation progresses, as soon as the coil 24" becomes sufficiently small that it becomes possible to insert the rolls 30 in the eye 31 of the coil 24", which (eye 31) drops lower and lower as the diameter of the coil decreases, the mandrel 29 is pushed into the eye 31 of the coil from both sides. The rolls 30 arranged on the mandrels 29 ensure that the coil 24" is held on the carriage 12" until it has been completely uncoiled.

The control and monitoring devices necessary for pushing in the mandrels 29, driving the rolls 30, and moving the rolls 20, the carriage 12 and the rolls 7, 7' are not shown in FIGS. 1 to 3.

The carriage (12, 12', 12") and the support rolls (20, 20', 20") can have a common displacement drive, or their drives can be coupled.

LIST OF REFERENCE NUMBERS

1 coiling station
2 uncoiling station
3 strip
4 entry rolls
5 bending rolls
6 rolls
7 rolls
8 coiling chamber
9 roller table roll
10 strip coil opener
11 peeling tool
12 carriage
13 column
14 drive rolls
15 piston-cylinder unit
16 drive unit
17 displacement cylinder
18 piston-cylinder unit
19 piston-cylinder unit
20 roll
21 elbow lever
22 roller table roll
23 roll
24 coil
25 lever
26 piston-cylinder unit
27 idler roll
28 support roll
29 mandrel
30 roll
31 coil eye

The invention claimed is :

1. Equipment for the optional coiling of partly rolled strip (3) product, transfer and uncoiling of the formed coils (24), or for allowing the partly rolled product to pass through uncoiled, with a set of bending rolls (5, 5', 5"), which produces a downward bend in the rolled product passing through it, with a roller table (6, 7, 9), whose drive rolls support the coiling operation and effect uncoiling operations and further conveyance of formed coils to free the coiling position, and with a drive unit (16) that conveys partly rolled product that is passing through or that has been uncoiled, wherein at least one support roll (20, 20', 20") is provided, which runs on the periphery of the coil (24, 24', 24") that is to be transferred and/or has been transferred into the uncoiling position and holds the coil in the uncoiling position, wherein rolls (23, 23') are provided that support and rotationally drive the coils (24, 24'; 24") that are to be uncoiled and the rolls (23, 23') and the at least one support roll (20, 20', 20") that supports the periphery of the coils can be simultaneously power driven to move in a running direction of the partly rolled product, and further comprising at least one drive (19) for moving the at least one support roll (20, 20', 20") vertically, wherein the at least one drive (19) is equipped with a control device, which vertically lowers the support roll (20) as a function of the coil diameter and/or an uncoiled length and/or an uncoiling time.

2. Equipment in accordance with claim 1, wherein the support rolls (23, 23') for the coils are arranged in a common carriage (12, 12', 12"), and the carriage (12, 12', 12") is arranged to be movable in the running direction of the partly rolled product.

3. Equipment in accordance with claim 1, wherein the carriage (12, 12', 12") and the at least one support roll (20, 20', 20") have a common displacement drive, or their drives are coupled.

4. Equipment in accordance with claim 1, wherein a lever (25) can be lowered onto the partly rolled product (strip 3') that is running off the coil, and that the lever has an idler roll (27), which rests on the partly rolled product (3'), and a support roll (28), which is positioned at a higher level and rests against the periphery of the coil (24').

5. Equipment in accordance with claim 4, wherein the lever (25) can be lowered as a function of the coil diameter and/or the uncoiled length and/or the uncoiling time.

6. Equipment in accordance with claim 1, wherein mandrels (29) are provided on both sides of the roller table in the end position of the eye (31) of a coil (24") that is to be uncoiled and can be inserted in the eye.

7. Equipment in accordance with claim 6, wherein the mandrels (29) can be inserted in the eye (31) of the end portion of the coil (24") as a function of the coil diameter and/or the uncoiled length and/or the uncoiling time.

* * * * *